US012077340B2

(12) United States Patent
Fukumoto

(10) Patent No.: US 12,077,340 B2
(45) Date of Patent: Sep. 3, 2024

(54) CAN CONTAINER

(71) Applicant: TOYO SEIKAN CO., LTD., Tokyo (JP)

(72) Inventor: Hayato Fukumoto, Kanagawa (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 17/781,103

(22) PCT Filed: Nov. 5, 2020

(86) PCT No.: PCT/JP2020/041419
§ 371 (c)(1),
(2) Date: May 31, 2022

(87) PCT Pub. No.: WO2021/111798
PCT Pub. Date: Oct. 6, 2021

(65) Prior Publication Data

US 2023/0002101 A1 Jan. 5, 2023

(30) Foreign Application Priority Data

Dec. 3, 2019 (JP) ..... 2019-218962

(51) Int. Cl.
*B65D 1/16* (2006.01)
*B21D 51/26* (2006.01)
*B65D 1/46* (2006.01)

(52) U.S. Cl.
CPC ..... *B65D 1/16* (2013.01); *B21D 51/26* (2013.01); *B65D 1/46* (2013.01)

(58) Field of Classification Search
CPC ..... B65D 51/02; B65D 51/007; B65D 17/02; B65D 15/20; B65D 15/18; B65D 15/16;
(Continued)

(56) References Cited

U.S. PATENT DOCUMENTS 3,416,703 A * 12/1968 Chmielowiec ..... B65D 1/46 220/651
3,693,828 A * 9/1972 Kneusel ..... B05B 13/0681 220/608

(Continued)

FOREIGN PATENT DOCUMENTS

CN 204776466 U 11/2015
CN 204916414 U 12/2015

(Continued)

OTHER PUBLICATIONS

International Search Report and Written Opinion of the International Searching Authority issued in International Patent Application No. PCT/JP2020/041419, dated Jan. 19, 202, along with English translation thereof.

(Continued)

*Primary Examiner* — Kareen K Thomas
(74) *Attorney, Agent, or Firm* — Greenblum & Bernstein, P.L.C.

(57) ABSTRACT

To provide a can container to achieve a higher pressure resistance strength by improving the shape of the bottom part of the can container. The can container includes a can barrel and a can bottom, the can bottom provided with, in a center thereof, a dome part concaved toward the inside of the can container along the can axis direction, and an annular convex part projecting toward the outside of the can container to shape an annular support part in an outer periphery of the dome part, wherein an inner peripheral surface extending from the support part of the annular convex part to an outer peripheral edge part of the dome part includes a recessed part where the outer peripheral edge part of the dome part is positioned in a direction of being farther away from the can axis than an innermost part of the inner peripheral surface.

13 Claims, 5 Drawing Sheets

(58) Field of Classification Search
CPC ..... B65D 15/14; B65D 15/12; B65D 15/10; B65D 15/08; B65D 15/06; B65D 15/04; B65D 15/02; B65D 7/04; B65D 1/20; B65D 1/18; B65D 1/14; B65D 1/12; B65D 1/16; B65D 1/46; B65D 1/165; B21D 51/26; F16N 3/00
See application file for complete search history.

(56) References Cited

U.S. PATENT DOCUMENTS

| | | | | | |
|---|---|---|---|---|---|
| 4,147,271 | A * | 4/1979 | Yamaguchi | B65D 1/165 | 220/609 |
| 4,266,685 | A * | 5/1981 | Lee, Jr. | B65D 7/42 | 413/1 |
| 4,834,256 | A * | 5/1989 | McMillin | B65D 21/0217 | 220/606 |
| 5,261,558 | A * | 11/1993 | Claydon | B65D 1/165 | D9/520 |
| 5,351,852 | A * | 10/1994 | Trageser | B21D 51/26 | 220/606 |
| 5,394,727 | A | 3/1995 | Diekhoff et al. | | |
| 5,421,480 | A * | 6/1995 | Cudzik | B65D 1/165 | 220/624 |
| 5,718,352 | A * | 2/1998 | Diekhoff | B65D 1/0207 | 220/604 |
| 5,971,259 | A * | 10/1999 | Bacon | B65D 15/06 | 220/619 |
| 6,131,761 | A * | 10/2000 | Cheng | B65D 1/165 | 220/608 |
| 6,132,155 | A * | 10/2000 | Gouliard | B21D 51/26 | 413/1 |
| 6,296,139 | B1 * | 10/2001 | Hanafusa | B21D 51/26 | 220/608 |
| 2003/0150866 | A1 | 8/2003 | Brifcani et al. | | |
| 2005/0115294 | A1 | 6/2005 | Kanou et al. | | |
| 2005/0218140 | A1 * | 10/2005 | Enoki | B65D 7/04 | 220/62.22 |
| 2007/0102434 | A1 * | 5/2007 | Dunwoody | B65D 15/14 | 206/524.1 |
| 2023/0202715 | A1 * | 6/2023 | Yamamoto | B65D 1/165 | 220/62.12 |
| 2023/0227237 | A1 * | 7/2023 | Leizer | B65D 17/4011 | 222/387 |

FOREIGN PATENT DOCUMENTS

| | | | |
|---|---|---|---|
| EP | 0417436 | | 3/1991 |
| JP | 4-123825 | A | 4/1992 |
| JP | 9-285832 | A | 11/1997 |
| JP | 2016-43991 | A | 4/2016 |
| TW | 292998 | B | 12/1996 |
| TW | 325423 | B | 1/1998 |

OTHER PUBLICATIONS

Office Action in Taiwanese Counterpart Patent Appl. No. 109141620, dated Jul. 12, 2021, along with an English translation thereof.
Office Action in Indian Counterpart Patent Appl. No. 202217023405, dated Aug. 2, 2022, along with an English translation thereof.
Office Action of corresponding family member Chinese Application No. 202080073788.2, dated Mar. 28, 2023 and English language translation thereof.
Extended European Search Report Issued in Corresponding EP Patent Application No. 20895157.4, dated Jan. 3, 2024.
English translation of Office Action Issued in Corresponding Indian Patent Application No. 202217023405, dated Mar. 21, 2024.
Office Action issued in Corresponding CN Patent Application No. 202080073788.2, dated Nov. 15, 2023, along with an English translation thereof.
Office Action issued in Corresponding Vietnamese Patent Application No. 1-2022-02564, dated Mar. 29, 2024, along with an English translation thereof.
Office Action issued in Corresponding CN Patent Application No. 202080073788.2, dated Apr. 18, 2024, along with an English translation thereof.

* cited by examiner

CAN CONTAINER

TECHNICAL FIELD

The present invention relates to a can container.

BACKGROUND ART

Two-piece cans and bottle-shaped cans have been known as can containers filled with contents, such as beverages and foods, and sealed. Each of these can containers has at least a can barrel and a can bottom.

In order to reduce raw materials used in such can containers, reducing the weight of the container by reducing the sheet thickness thereof has been promoted, and the shape of the can bottom has been innovated as necessary in order to obtain a predetermined pressure resistance strength of the container, even with the reduced sheet thickness.

The can bottom shape for increasing the pressure resistance strength is generally achieved by shaping a dome part in which the center of the can bottom is concaved into a dome shape toward an inside of the can container along a direction of a can axis, and shaping an annular convex part functioning as a support part on an outer peripheral edge of the dome part.

In addition, in order to increase the pressure resistance strength, there has been proposed the prior art in which the shapes of the dome part and the annular convex part described above are appropriately designed, wherein, for example, an inner peripheral wall of the annular convex part that is connected to the dome part is shaped to include a first concave curved surface part that has, in a vertical cross section view along the direction of a can axis, a curved shape concaved toward the outside in a radial direction orthogonal to the can axis, the dome part is shaped to include a dome top positioned on the can axis, and a second concave curved surface part that is connected to a radially outer side of the dome top and forms a concave curved shape having a smaller radius of curvature than the dome top, and an outer peripheral edge part of the dome part is shaped to include a linear taper part that connects the first concave curved surface part and the second concave curved surface part described above and comes into contact with the first curved surface part and the second curved surface part (see PTL 1 below).

CITATION LIST

PATENT LITERATURE

[PTL 1] Japanese Patent Application Publication No. 2016-43991

SUMMARY OF INVENTION

TECHNICAL PROBLEM

According to the prior art described above, after forming the dome part and the annular convex part on the bottom part, the inner peripheral wall of the annular convex part described above is reformed to shape the first concave curved surface part and the taper part described above, wherein the first concave curved surface part is roll-formed to forms a curved surface by a formed surface of a forming tool. In such reforming using a forming roll, it is inevitable that the curved surface of the first concave curved surface part has a radius of curvature that is large enough to implement the roll formation, and there is a limit to causing the inner peripheral surface of the annular convex part to concave deeper toward the outside in the radial direction orthogonal to the can axis.

Furthermore, in the prior art described above, in roll-forming the first concave curved surface part, it is necessary to prevent the roll from interfering with the dome part, and consequently there is a limit to increasing the distance (height h) in the direction of the can axis between the center of the radius of curvature (R1) of the first concave curved surface part and a nose part (an outer edge of the annular convex part along the direction of the can axis).

For this reason, in the prior art, even if the reforming is performed, the inner peripheral surface of the annular convex part cannot be concaved deeper toward the outside in the radial direction orthogonal to the can axis, and the distance in the direction of the can axis between the center of the radius of curvature of the first concave curved surface part and the nose part cannot be further increased, leading to a problem that the pressure resistance strength cannot be improved effectively.

Also, in the prior art, attempting to achieve a deeper concave by means of roll forming leads to the destruction of the oxide film of the aluminum alloy, which is the material of the can, and sterilizing the can after filling the can with contents causes blackening of the surface of a roll-formed part, deteriorating the aesthetic appearance of the product.

The present invention was contrived in order to address such circumstances. That is, an object of the present invention is to provide a can container that can obtain higher pressure resistance strength and maintain the aesthetic appearance of the product by further improving the shape of the bottom part of the can container.

SOLUTION TO PROBLEM

In order to achieve this object, a can container according to the present invention includes the following configurations.

A can container, including a can barrel and a can bottom, the can bottom being provided with, in a center thereof, a dome part concaved toward an inside of the can container along a direction of a can axis, and an annular convex part that projects toward an outside of the can container so as to shape an annular support part in an outer periphery of the dome part, wherein an inner peripheral surface extending from the support part to an outer peripheral edge part of the dome part includes a recessed part in which the outer peripheral edge part of the dome part is positioned in a direction farther away from the can axis than an innermost part of the inner peripheral surface.

ADVANTAGEOUS EFFECTS OF INVENTION

The can container with such characteristics can provide a can container that can achieve a higher pressure resistance strength by improving the shape of the bottom part of the can container.

DESCRIPTION OF EMBODIMENTS

Figure 1:
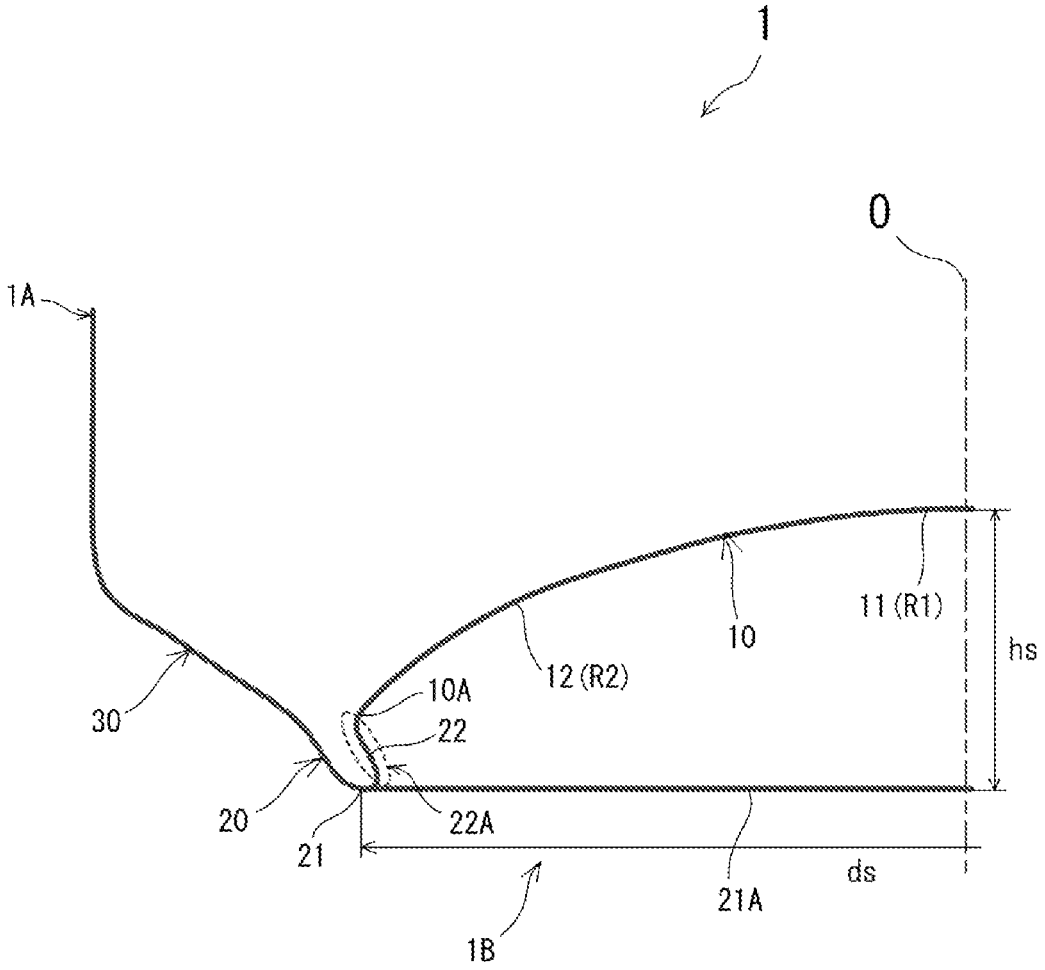
FIG. 1 is a vertical cross section view of a main part of a can container according to an embodiment of the present invention (vertical cross section view along a can axis).

An embodiment of the present invention is now described hereinafter with reference to the drawings. In the following description, like reference numerals shown in different drawings represent parts with like functions, and therefore redundant descriptions of the drawings are omitted accordingly. Furthermore, the cross section views of FIGS. 1 and 2 each show the cross section shape by a diagram in which the description of a sheet thickness is omitted.

As shown in FIG. 1, a can container 1 according to an embodiment of the present invention includes a can barrel 1A and a can bottom 1B, the can barrel 1A and the can bottom 1B having an identical shape over the entire circumference around a can axis ○. The can bottom 1B includes a dome part 10 and an annular convex part 20, and in the illustrated example, an outer wall part 30 is provided on the outside of the annular convex part 20.

The dome part 10 is provided in the center of the can bottom 1B and includes a curved surface concaved into a dome shape toward the inside of the can container 1 along the direction of the can axis ○. In the illustrated example, the curved surface of the dome part 10 includes, at a central part thereof, a first curved surface 11 having a radius of curvature R1 and, around the first curved surface 11, a second curved surface 12 having a radius of curvature R2 smaller than the radius of curvature R1. The configuration of the dome part 10 is not limited thereto; the dome part 10 may be a curved surface having a single radius of curvature.

The annular convex part 20 is shaped projecting outward along the direction of the can axial of the can container 1 so as to shape an annular support part 21 around the outer periphery of the dome part 10. The support part 21 is a part that supports the can container 1 on a plane, and is shaped on a support surface 21A orthogonal to the can axis ○.

In the can bottom 1B, an inner peripheral surface 22 extending from the support part 21 of the annular convex part 20 to an outer peripheral edge part 10A of the dome part 10 has a recessed part 22A that is inclined in a direction in which the inner peripheral surface 22 separates from the can axis ○, the recessed part 22A being connected to the outer peripheral edge part 10A of the dome part 10.

Figure 2:
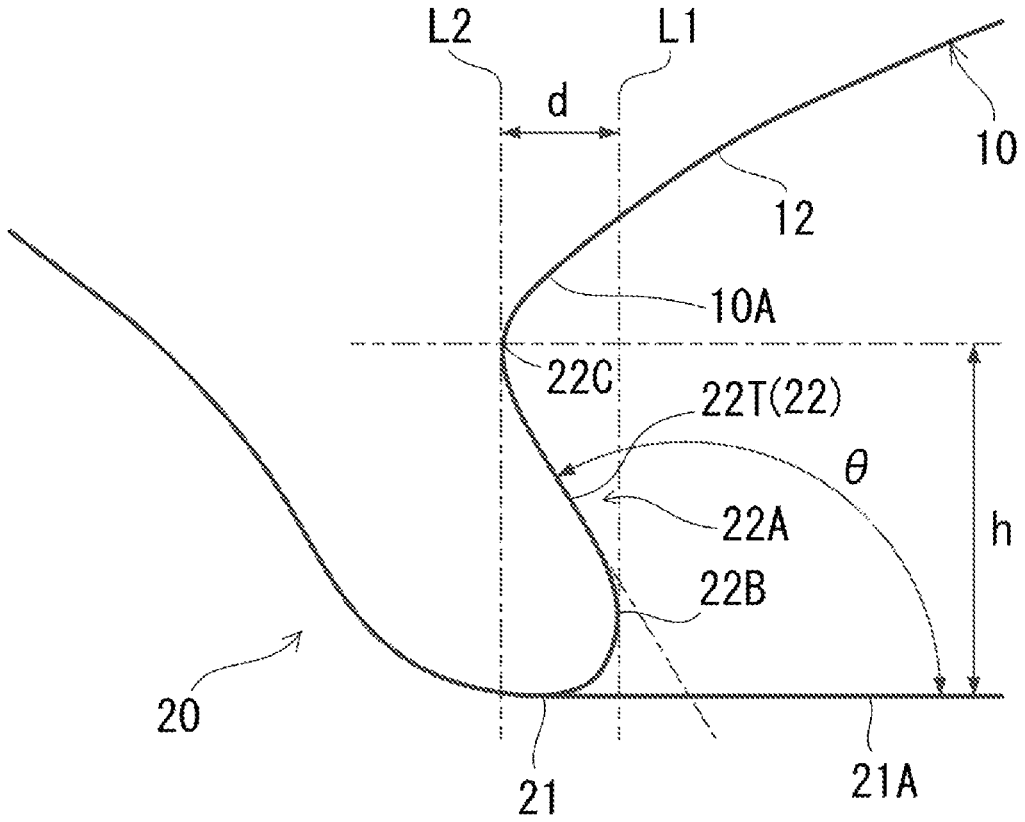
FIG. 2 is an enlarged vertical cross section view of an annular convex part (vertical cross section view along the can axis).

As shown in FIG. 2, in the recessed part 22A in the inner peripheral surface 22 of the annular convex part 20, the outer peripheral edge part 10A of the dome part 10 is positioned farther away from the can axis ○ than an innermost part 22B of the inner peripheral surface 22 (a part of the inner peripheral surface 22 that is closest to the can axis ○). Therefore, an imaginary line L1 that is in contact with the innermost part 22B of the inner peripheral surface 22 and parallel to the can axis ○ intersects with a curved surface of the dome part 10 (for example, the second curved surface 12).

Moreover, in a more specific example, the recessed part 22A in the inner peripheral surface 22 includes a linear tapered surface 22T in a vertical cross section view along the can axis ○. The tapered surface 22T shapes an obtuse inclination angle θ with the support surface 21A that is in contact with the support part 21 described above. This inclination angle θ is an angle on the can axis ○ side, between the tapered surface 22T and the support surface 21A, and the angle is preferably set to 100° to 125° in order to obtain a high pressure resistance strength of the can bottom 1B.

The recessed part 22A on the inner peripheral surface 22 reaches the outer peripheral edge part 10A of the dome part 10 through a concave of an outermost part 22C (a part of the inner peripheral surface 22 that is farthest from the can axis ○), from the tapered surface 22T described above. The outermost part 22C is not shaped by roll forming as in the prior art described above, but is shaped as a bent part resulting from compressive deformation in the direction of the can axis, so that the radius of curvature of the curved surface of the outermost part 22C is set to be smaller (for example, 0.7 mm or less) than the radius of curvature of the first concave curved surface part in the prior art.

Accordingly, the outermost part 22C on the inner peripheral surface 22 can be concaved deeper in the direction away from the can axis ○ in relation to the innermost part 22B on the inner peripheral surface 22. Here, assuming that an imaginary line in contact with the outermost part 22C and parallel to the can axis ○ is L2, the distance d (depth of the recessed part 22A) between the imaginary line L1 described above and the imaginary line L2 is preferably set to 0.3 mm to 1.0 mm in order to obtain a high pressure resistance strength of the can bottom 1B.

Also, when the outermost part 22C of the inner peripheral surface 22 is a compressive deformation bent part, a roll forming trace that is generated when shaping the curved surface by means of the roll forming as in the prior art does not exist on the inner peripheral surface 22. For this reason, the aesthetic appearance of the inner peripheral surface 22 that includes the outermost part 22C shaped as the compressive deformation bent part can be prevented from being degraded by the roll forming trace (blackening caused by the destruction of the aluminum oxide film) When the outermost part 22C is taken as a compressive deformation bent part, the height h from the support surface 21A to the outermost part 22C is the forming height. This height h is preferably 2.0 mm to 4.0 mm in order to obtain a high pressure resistance strength of the can bottom 1B.

Figure 3:
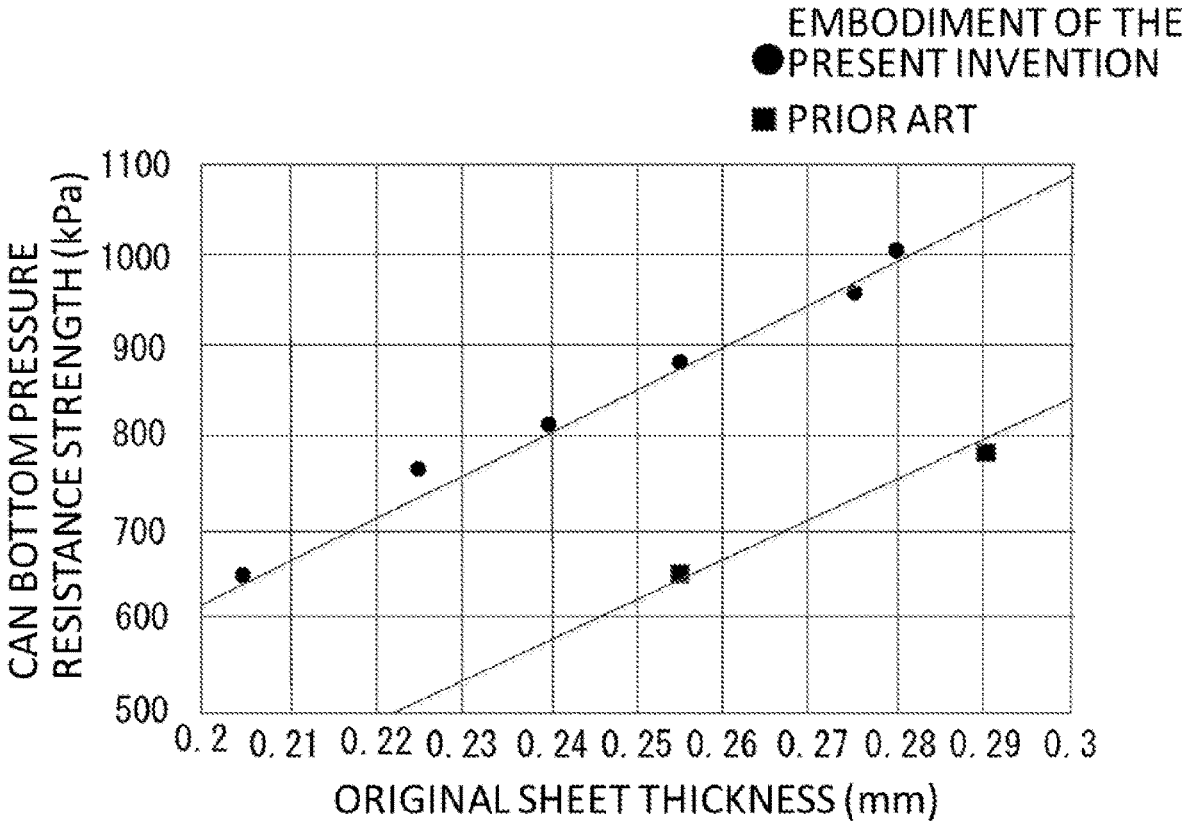
FIG. 3 is a graph showing the difference in can bottom pressure resistance strength between the embodiment of the present invention and the prior art.

The embodiment of the present invention having such a can bottom shape has a higher can bottom pressure resistance strength than the prior art described above. The can bottom pressure resistance strength here refers to the buckling strength of the can bottom obtained when the concave shape of the can bottom is completely inverted. When a dome depth hs of the can bottom and a grounding diameter ds (see FIG. 1) are set to hs=10.63 mm and ds=45.5 mm, and when comparing the can bottom pressure resistance strength of the embodiment of the present invention (θ=115°, h=2.6 mm) and the can bottom pressure resistance strength of the prior art for each original sheet thickness, the strength of the embodiment of the present invention is approximately 1.2 to 1.5 times higher than that of the prior art as shown in FIG. 3.

Figure 4:
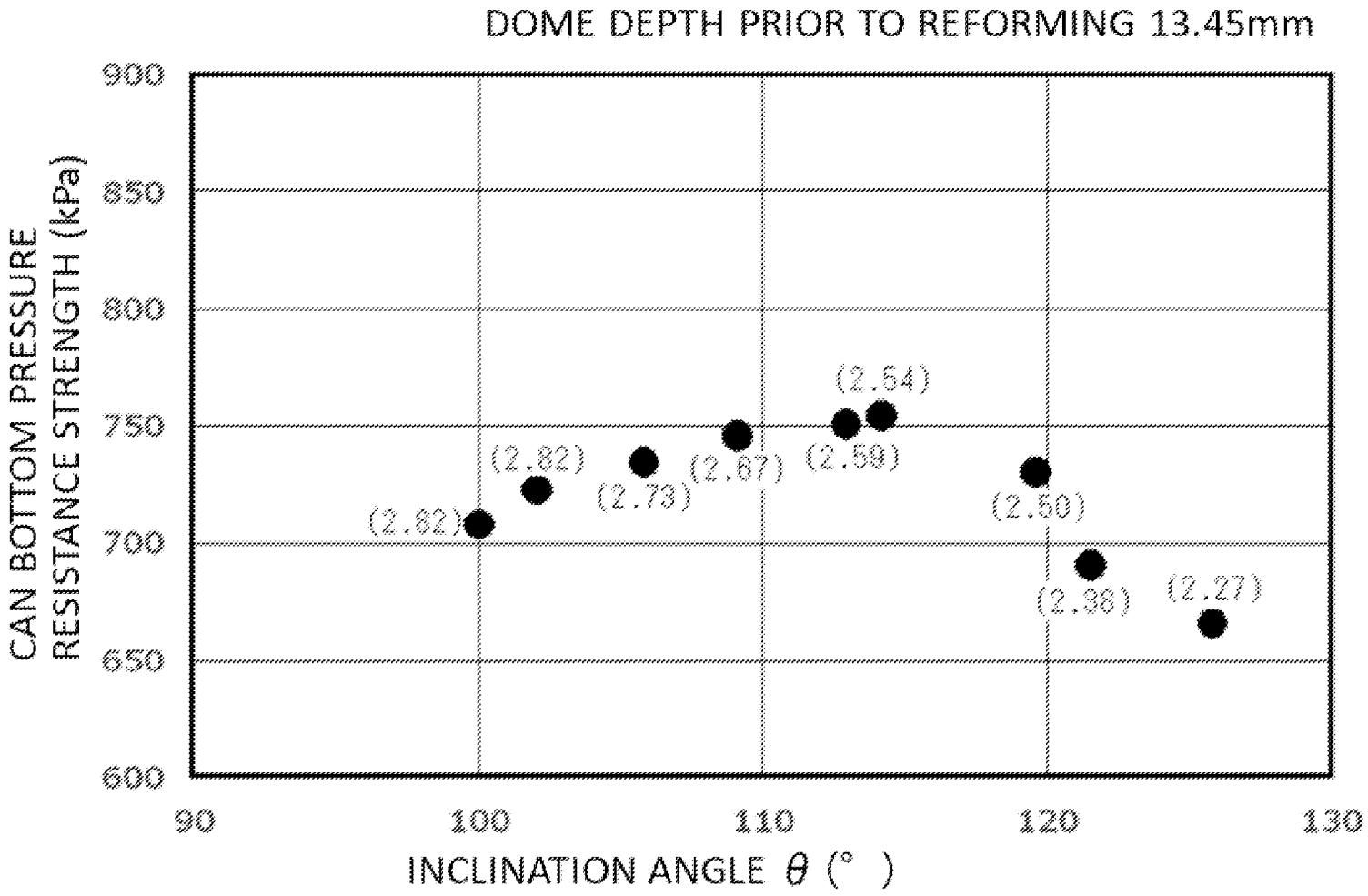
FIG. 4 is a graph of a can bottom pressure resistance strength measurement value (dome depth prior to reforming is 13.45 mm) obtained when an inclination angle θ is changed.
Figure 5:
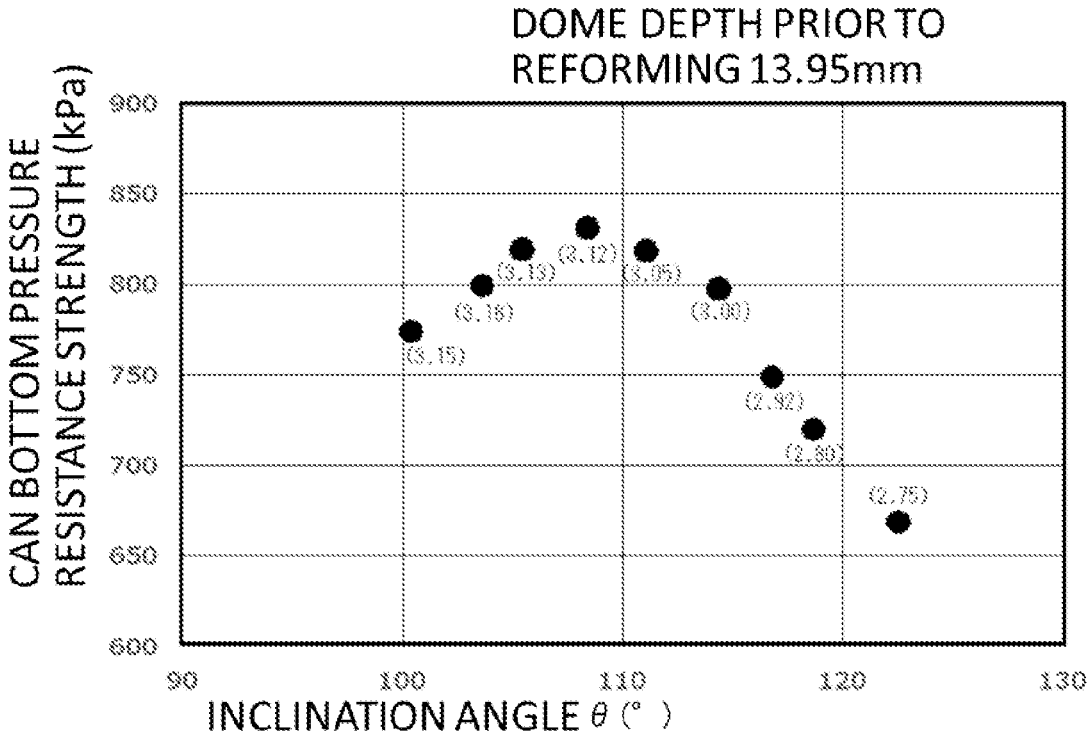
FIG. 5 is a graph of a can bottom pressure resistance strength measurement value (dome depth prior to reforming is 13.95 mm) obtained when the inclination angle θ is changed.

The recessed part 22A described above is shaped by forming the dome part 10 and the annular convex part 20 in the can bottom 1B and then reforming the dome part 10 and the annular convex part 20 to cause compressive deformation. FIGS. 4 and 5 each show the difference in can bottom pressure resistance strength between cans with two types of bottom shapes (capacity: 350 ml, grounding diameter of ϕ49) having a dome depth prior to reforming of 13.45 mm and 13.95 mm, the difference being obtained after the above-mentioned inclination angle θ is changed and the reforming is performed. The values in the parentheses in the drawings indicate the values of the height h (the forming height from the support surface 21A to the outermost part 22C) shown in FIG. 2 obtained when the inclination angle θ is changed.

When the inclination angle θ is in the range of 100° to 125° , a desired can bottom pressure resistance strength can be obtained. The larger the dome depth hs of the can bottom, the higher the can bottom pressure resistance strength, but if the dome depth hs is increased, it becomes inevitably difficult to secure the internal volume of the can required for the can container to be filled with the contents from a certain range. In addition, the larger the inclination angle θ is within a certain range, the higher the can bottom pressure resistance strength becomes, but when the inclination angle θ exceeds the certain range, the deformation mode changes, thereby inverting only the dome part 10 and lowering the can bottom pressure resistance strength.

Using a hydraulic buckling tester, the can bottom pressure resistance strength described above was measured as the lowest internal pressure at which the concave shape of the can bottom was inverted, by sealing the inside of the can container near the center of the can barrel in the direction of the can axis, with the can container being placed upright without fixing the can bottom, and injecting water to raise the pressure inside the can container at a pressure increasing speed of 30 kPals by the water pressure.

Required values of the can bottom pressure resistance strength vary depending on the type of the container, the type of the liquid of the content, the sterilization conditions, and the like. However, when, for example, filling the container with some carbonated drink, a high pressure resistance strength is required, but even in such a case, it is determined that a pressure resistance strength of 690 kPa is sufficient.

Although the embodiment of the present invention has been described above in detail with reference to the drawings, specific configurations of the present invention are not limited thereto, and design modifications and the like not departing from the gist of the present invention are also included in the present invention.

Reference Signs List

1 Can container
1A Can barrel
1B Can bottom
10 Dome part
10A Outer peripheral edge part
11 First curved surface
12 Second curved surface
20 Annular convex part
21 Support part
21A Support surface
22 Inner peripheral surface
22A Recessed part
22B Innermost part
22C Outermost part
22T Tapered surface
○ Can axis
θ Inclination angle

What is claimed is:

1. A can container, comprising:

a can barrel and a can bottom, the can bottom being provided with, in a center thereof, a dome part concaved toward an inside of the can container along a direction of a can axis, and an annular convex part that projects toward an outside of the can container so as to shape an annular support part in an outer periphery of the dome part, wherein an inner peripheral surface extending from the support part to an outer peripheral edge part of the dome part includes a recessed part in which the outer peripheral edge part of the dome part is positioned in a direction farther away from the can axis than an innermost part of the inner peripheral surface, and a depth of the recessed part is 0.3 mm to 1.0 mm.

2. The can container according to claim 1, wherein an imaginary line in contact with the innermost part and parallel to the can axis intersects with a curved surface of the dome part.

3. The can container according to claim 1, wherein the recessed part includes a linear tapered surface in a vertical cross section view along the can axis.

4. The can container according to claim 3, wherein an inclination angle on the can axis side between the tapered surface and a support surface in contact with the support part is 100° to 125°.

5. The can container according to claim 4, wherein a height from the support surface to an outermost part of the inner peripheral surface is 2.0 mm to 4.0 mm.

6. The can container according to claim 1, wherein the outermost part of the inner peripheral surface is a compressive deformation bent part.

7. The can container according to claim 1, wherein a roll forming trace does not exist on the inner peripheral surface.

8. The can container according to claim 2, wherein the recessed part includes a linear tapered surface in a vertical cross section view along the can axis.

9. The can container according to claim 8, wherein an inclination angle on the can axis side between the tapered surface and a support surface in contact with the support part is 100° to 125°.

10. The can container according to claim 9, wherein a height from the support surface to an outermost part of the inner peripheral surface is 2.0 mm to 4.0 mm.

11. The can container according to claim 5, wherein the outermost part of the inner peripheral surface is a compressive deformation bent part.

12. The can container according to claim 10, wherein the outermost part of the inner peripheral surface is a compressive deformation bent part.

13. A can container, comprising:

a can barrel and a can bottom, the can bottom being provided with, in a center thereof, a dome part concaved toward an inside of the can container along a direction of a can axis, and an annular convex part that projects toward an outside of the can container so as to shape an annular support part in an outer periphery of the dome part, wherein an inner peripheral surface extending from the support part to an outer peripheral edge part of the dome part includes a recessed part in which the outer peripheral edge part of the dome part is positioned in a direction farther away from the can axis than an innermost part of the inner peripheral surface, wherein the recessed part includes a linear tapered surface in a vertical cross section view along the can axis, wherein an inclination angle on the can axis side between the tapered surface and a support surface in contact with the support part is 105° to 110°, and wherein a height from the support surface to an outermost part of the inner peripheral surface is 3.0 mm to 4.0 mm.

* * * * *